US005692713A

United States Patent [19]

Xiao

[11] Patent Number: 5,692,713

[45] Date of Patent: Dec. 2, 1997

[54] ARM BRACE

[76] Inventor: Ji Xiao, 2540 S. Maryland Pkwy., Box 159, Las Vegas, Nev. 89109

[21] Appl. No.: 628,101

[22] Filed: Apr. 9, 1996

Related U.S. Application Data

[63] Continuation-in-part of Ser. No. 273,124, Jul. 14, 1994, Pat. No. 5,522,573.

[51] Int. Cl.[6] ..... A45F 5/00

[52] U.S. Cl. ..... 248/118; 224/267

[58] Field of Search ..... 248/118, 118.3, 248/242, 240, 291.1, 292.12, 284.1; 224/101, 222, 267; 42/94

[56] References Cited

U.S. PATENT DOCUMENTS

| | | | |
|---|---|---|---|
| 46,365 | 2/1865 | Kinman . | |
| 281,333 | 7/1883 | Butler . | |
| 1,607,887 | 11/1926 | Fowler | 248/242 X |
| 2,172,178 | 9/1939 | Rosenberg . | |
| 2,483,758 | 10/1949 | Douglas | 248/242 |
| 2,707,071 | 4/1955 | Adams . | |
| 3,200,528 | 8/1965 | Christensen . | |
| 3,390,477 | 7/1968 | Galbraith . | |
| 4,211,219 | 7/1980 | Alvey . | |
| 4,674,472 | 6/1987 | Reis . | |
| 4,844,390 | 7/1989 | Duke . | |
| 5,111,983 | 5/1992 | Simmons et al. . | |
| 5,351,867 | 10/1994 | Vest . | |

*Primary Examiner*—Ramon O. Ramirez
*Assistant Examiner*—Derek J. Berger
*Attorney, Agent, or Firm*—Richard C. Litman

[57] ABSTRACT

An arm brace, when positioned in the underarm intermediate a user's upper arm and the side of the user's torso, assists in the carrying of heavy objects at shoulder level. The arm brace includes two body contoured surfaces, one for receiving the upper arm and another for contacting the torso, that are hingedly attached to one another. An adjustable brace member or prop, which is adjustable at both ends, is used to fix the angle between these two surfaces at the desired value. The brace is held to the upper arm by a strap attached to the upper arm receiving surface. The arm brace allows a user to carry heavy loads without fatigue, discomfort, and with reduced risk of injury.

2 Claims, 8 Drawing Sheets

ARM BRACE

This application is a continuation-in-part of application Ser. No. 08/273,124, filed Jul. 14, 1994 now U.S. Pat. No. 5,522,573.

BACKGROUND OF THE INVENTION

1. Field of the Invention

The present invention relates to an arm brace. More particularly, the present invention relates to a support brace which steadies the arm and redistributes forces on the arm to the upper torso.

2. Description of the Prior Art

Various braces are known which restrict the relative position of the upper arm and the torso of an individual. U.S. Pat. No. 281,338 to Butler discloses an arm rest which includes a flexible arm band attached to an arm support member, a vertical torso support member hingedly attached to the arm support member, and an adjustable prop which allows the arm support member to be held at various angles with respect to the torso support member. Both the arm and torso support members are secured to their respective body parts with belts. The prop used by Butler is not adjustable at both ends.

Similarly, U.S. Pat. No. 46,365 to Kinman discloses an arm supporter which includes an adjustable arm support element hingedly and pivotally connected to a body support element. The body support element includes a rigid U-shaped brace which is secured to a rifleman's waste with a belt. Kinman does not show a brace, extending between the arm support element and the body support element, which is adjustable at both ends.

To assist in aiming a gun, U.S. Pat. No. 3,390,477 to Galbraith discloses an upper arm brace with a contoured arm rest. This brace is supported on a hip through an adjustable bifurcated rod to a belt mounted plate. U.S. Pat. No. 4,844,390 to Duke discloses another belt supported arm brace which is retractable, and pivots to hang from the waist when not in use.

A support device for cameramen that includes a brace member for both the thigh and upper arm is disclosed by U.S. Pat. No. 5,111,983 to Simmons et al. This device is secured to both the waist and upper body through belts and straps. A similar device, but without the belts or straps is disclosed by U.S. Pat. No. 2,172,178 to Rosenberg.

A body brace which is useful in preventing injury to a person lifting or carrying weights is disclosed by U.S. Pat. No. 4,211,219 to Alvey. Though this triangular device may be strapped to the arm, weight is distributed from the elbow to the pelvis, not from the humerus to the upper torso or thorax.

U.S. Pat. No. 2,707,071, issued to Dearborn J. Adams on Apr. 26, 1955, shows a brace for holding the forearm in spaced apart relationship relative to the side of a wearer. The brace of Adams does not have an upper arm supporting surface.

U.S. Pat. No. 3,200,528, issued to Harold C. Christensen on Aug. 17, 1965, shows a device for distributing the weight of a pistol on a shooter's waist while the pistol is being aimed. The device of Christensen does not have an upper arm supporting surface.

U.S. Pat. No. 4,674,472, issued to Daniel S. Reis on Jun. 23, 1987, shows a rest for distributing the weight of an archery bow on a shooter's hip. The device of Reis does not have an upper arm supporting surface.

U.S. Pat. No. 5,351,867, issued to Clyde L. Vest on Oct. 4, 1994, shows a Brace for supporting the forearm of an archer on the archer's hip. The device of Vest does not have an upper arm supporting surface.

None of the above inventions and patents, taken either singly or in combination, is seen to describe the instant invention as claimed.

SUMMARY OF THE INVENTION

In numerous occupational as well as recreational endeavors, heavy objects need to be carried by hand in a relatively stable manner. One well established method is to support the object on the palm of the hand at about shoulder height with the elbow pressed against the hip or the lateral thorax area of one's torso. When this method is employed repeatedly and/or for extended periods of time, various muscular and skeletal problems may develop and/or be aggravated. These problems arise from a combination of the weight carried, the distribution of that weight, and the contortions required to bear the weight.

The present invention provides an arm brace which, positioned in the underarm intermediate a user's upper arm and lateral part of the user's thorax, assists in carrying heavy objects at shoulder level and greatly reduces the problems arising from conventional unassisted methods. The arm brace includes two body contoured surfaces, one for receiving the upper arm and another for contacting the torso, that are hingedly attached to one another. An adjustable brace member or prop, which is adjustable at both ends, is used to fix the angle between these two surfaces at the desired value. The brace is held to the upper arm by a strap attached to the upper arm receiving surface. With the brace attached to the upper arm, a heavy object can be more easily supported at about shoulder height due to the torso-contacting surface distributing the weight of the object to the lateral part of the user's torso. The two ends of the prop attached to the body contoured surfaces can be locked in position to keep the angle between the body contoured surfaces constant, when the brace is in use.

The present invention is collapsible to reduce its bulk when not in use. The hinge at the point where the arm engaging surface meets the torso engaging surface, allows the brace to be folded so that the two body contoured surfaces lie next to each other. Optionally, mechanisms may be employed to secure the device in the collapsed state.

The present invention moves to an unobtrusive position when not in use. This naturally occurs when the arm is rotated from a lifting position to a rest position.

Accordingly, it is a principal object of the invention to provide a structural support for an individual to carry heavy objects at substantially shoulder height, which allows the user to maintain a substantially upright posture without fatigue, discomfort, and with reduced risk of injury.

Another object of the invention is to provide a device in which the support is positioned in the underarm when the upper arm is extended horizontally to the side, and the support is positioned to the rear when the arm is at rest.

Still another object of the invention is to distribute a significant portion of the weight of heavy objects from an upward load bearing arm of an individual to a lateral force onto the individual's thorax.

It is a further object of the invention to provide a support which may be collapsible into a more compact form to facilitate storage and/or to reduce bulk when not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following description and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
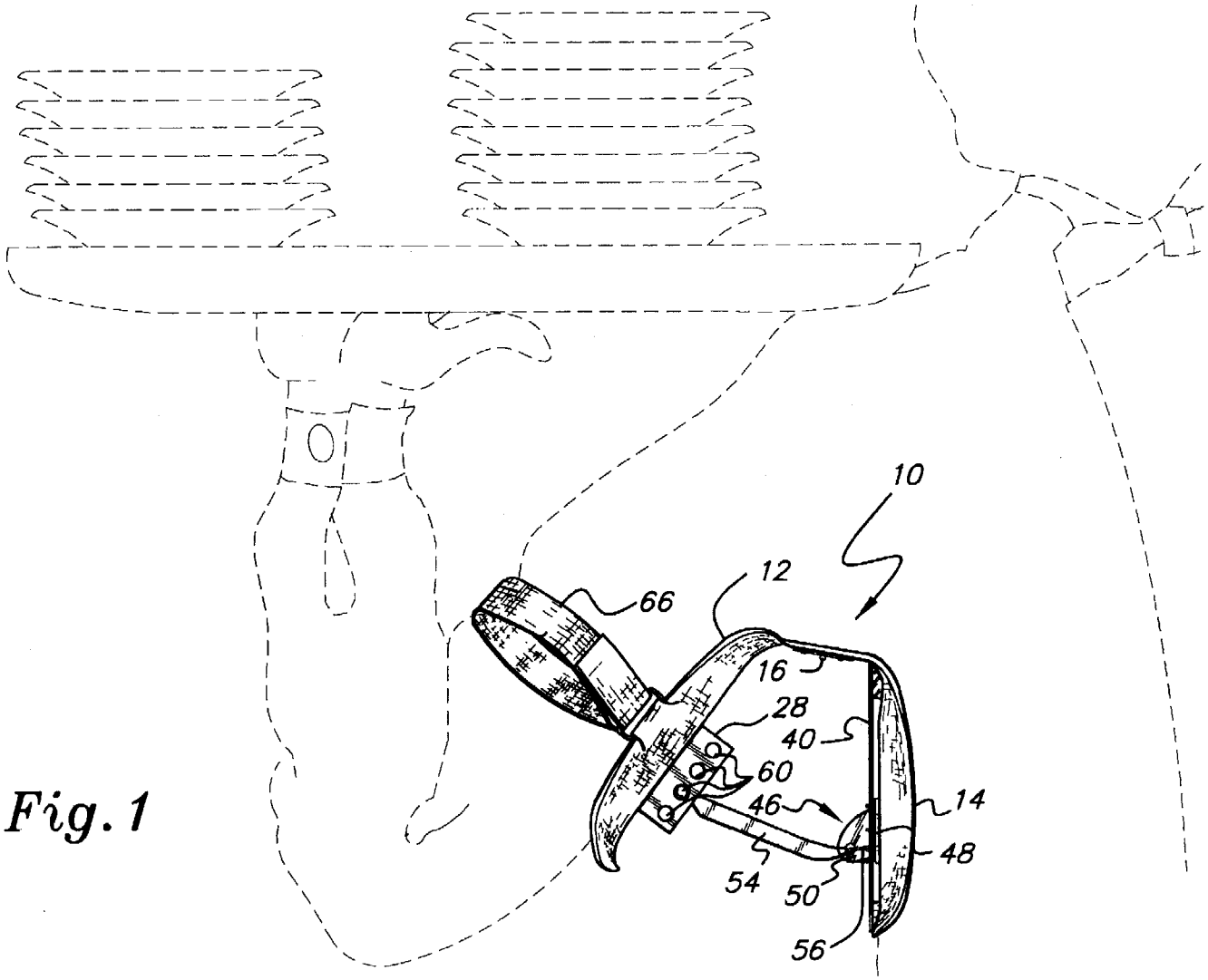
FIG. 1 is an environmental view of the first embodiment of the present invention, positioned for use.
Figure 2A:
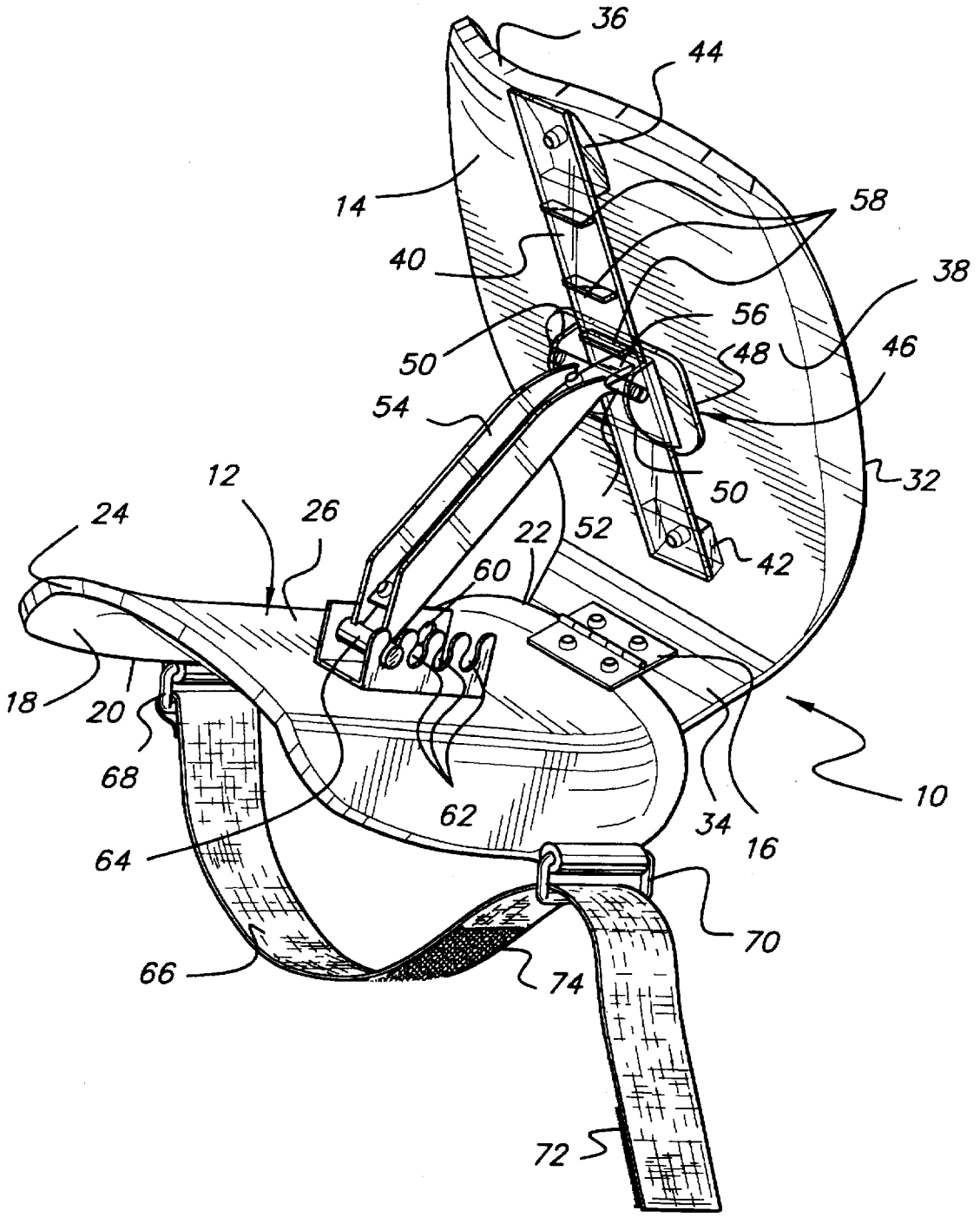
FIG. 2A is a perspective view of the first embodiment of the present invention shown with the prop attached to both body contoured surfaces.
Figure 2B:
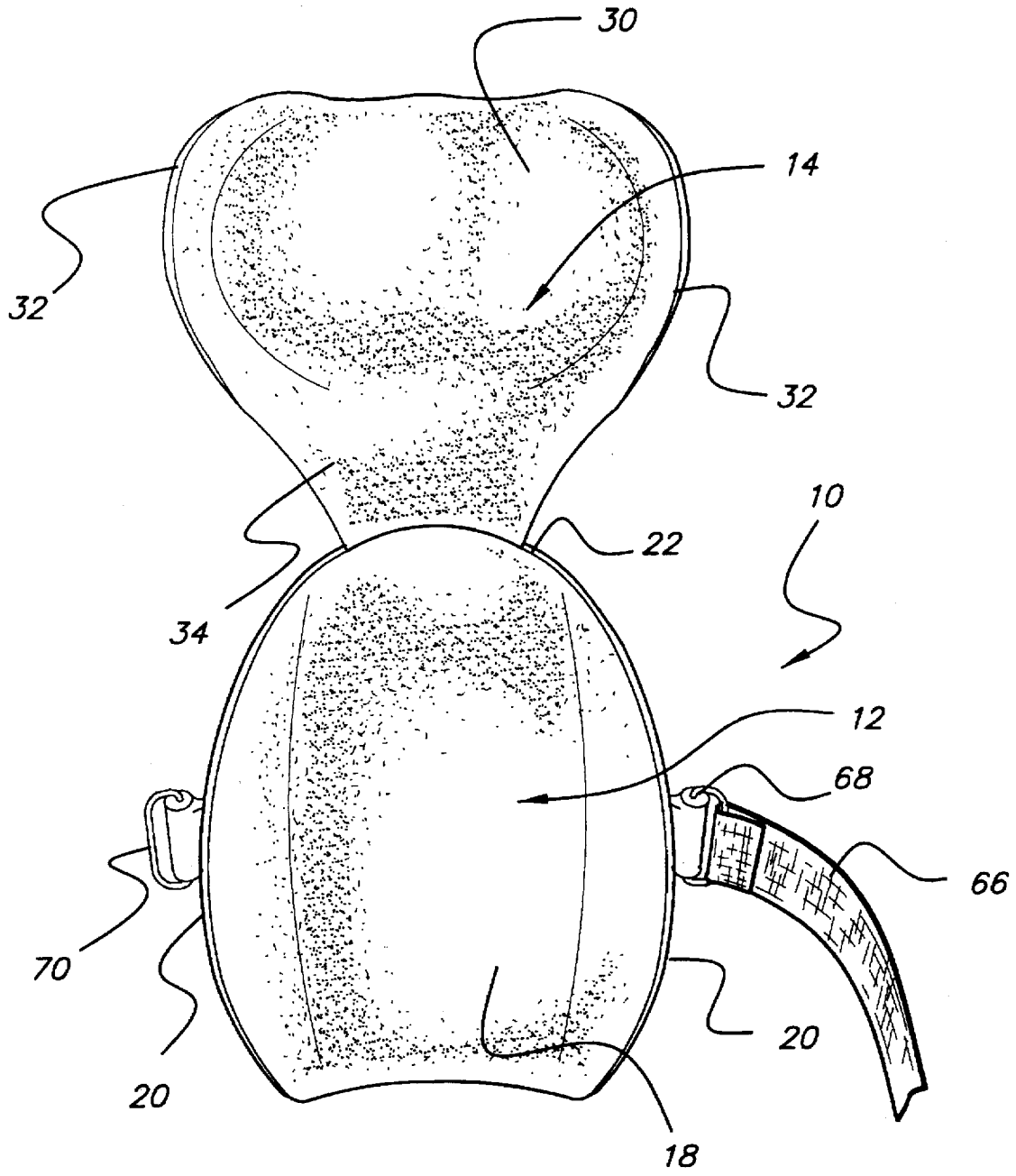
FIG. 2B is a head-on view showing the body contacting surfaces of the arm brace of the present invention.
Figure 3:
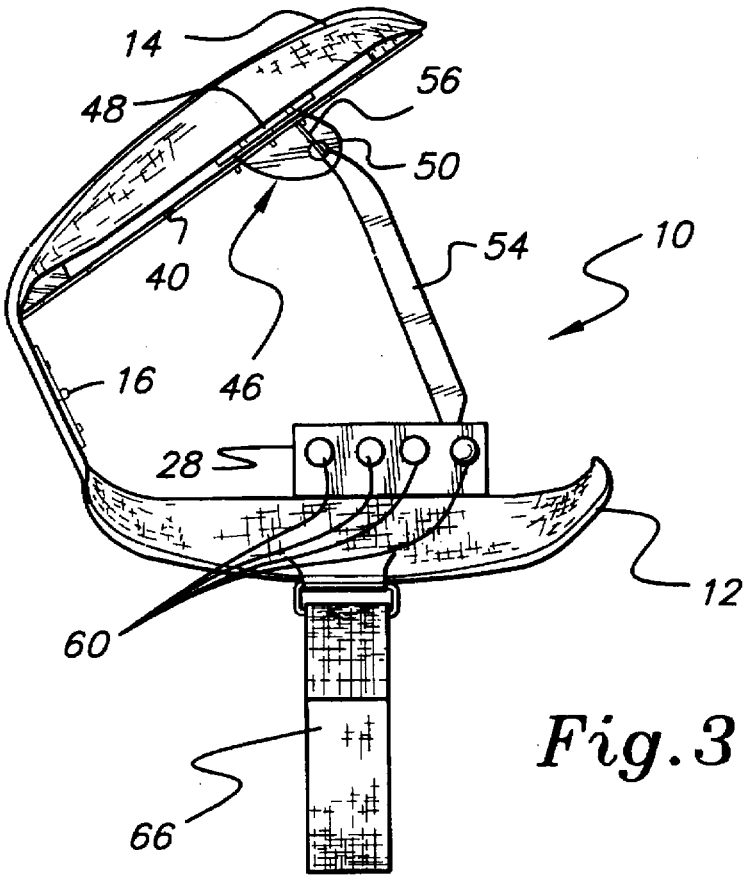
FIG. 3 is a side view of the first embodiment of the present invention shown with the prop attached to both body contoured surfaces.

With reference to FIGS. 1–7, the present invention is an arm brace 10 having an upper arm supporting plate 12 and a torso contacting plate 14. Plates 12 and 14 are connected together by a hinge 16.

Plate 12 has an upper arm supporting surface 18 which is preferably cushioned. Plate 12 also has sides 20 which curl toward surface 18 so as to cradle the user's upper arm when in use. The ends 22 and 24 of the plate 12 curl away from the surface 18 so as not to dig into the user's flesh and thus cause discomfort. The back surface 26 of the plate 12 has a bracket 28 attached thereto, the purpose of which will be described later.

Plate 14 has a torso contacting surface 30 which is preferably cushioned. Plate 14 also has sides 32 which curl toward surface 30 so as to cradle the side of the user's thorax when in use. The ends 34 and 36 of the plate 14 curl away from the surface 30 so as not to dig into the user's side and thus cause discomfort. The back surface 38 of the plate 14 has a guide 40 attached thereto, the purpose of which will be described later.

The guide 40 is maintained in a spaced-apart relationship with the back surface 38 by two spacers 42 and 44. A slide 46 slidably engages and is guided by the guide 40. The slide 46 has a base 48 which is positioned between the guide 40 and the surface 38 and which substantially fills the gap between the guide 40 and the surface 38. A pair of fins 50 extend perpendicularly from the base 48 such that one fin lies on each side of the guide 40. The distance between the fins 50 is substantially the same as the width of the guide 40. It should be apparent that this construction allows the slide 46 to slide freely between the spacers 42 and 44 while being confined to movement along the length of the guide 40.

The fins 50 rotationally support a shaft 52. The shaft 52 is fixed to a first end of a prop rod 54. A shaft 64 is rigidly fixed to the second end of the prop rod 54. The prop rod 54 is "C" shaped in cross section for added strength and rigidity. A projection 56 extends from the first end of the prop rod 54. The projection 56 is rigidly fixed to the first end of the prop rod 54 and projects beyond the shaft 52. The guide 40 has a series of ribs 58 projecting therefrom. Rotation of the prop rod 54 about the shaft 52 such that an acute angle is made between the prop rod 54 and the guide 40, clears the projection 56 out of the area in which the projection 56 can come into contact with ribs 58. Depending on the height selected for the ribs 58, the acute angle at which the projection 56 will clear the ribs 58 can range from zero to fifty degrees. Once the projection 56 is clear of the ribs 58, the slide 46 can be moved to any desired location along guide 40. The prop rod 54 is then rotated back about the shaft 52 such that the projection 56 can no longer clear the ribs 58. Then if the slide 46 is moved slightly until the projection 56 engages a nearby rib 58, the slide 46 will become fixed at the selected location along the guide 40.

The bracket 28 has a base that lies flat against the surface 26 and two upright walls which project perpendicularly out of the surface 26. One of the upright walls has a series of holes 60 which register with respective ones of a series of cutouts 62 formed in the other upright wall. Each cutout 62 has an essentially circular closed end and a narrow, relative to the diameter of the circular closed end, open end. The bracket 28 is made of a sufficiently resilient material such that once one end of the shaft 64 is inserted into a selected hole 60, the other end of the shaft 64 can be snapped into a respective cutout 62 to thereby fix the second end of the prop rod 54 at the desired location relative to the surface 26.

It should readily be apparent that the construction just described allows the angle between the plate 12 and the plate 14 to be set at any desired value by fixing the first and second ends of the prop rod 54 at the desired locations relative to the surfaces 38 and 26. Once the desired angle between the plates 12 and 14 has been set, the plate 12 can be secured to the user's upper arm by strap 66. The strap 66 is fixed at one end to the plate 12 by the D-ring 68. The strap 66 is wrapped around the upper arm and the free end thereof is threaded through the D-ring 70 and secured back on to the strap 66 by the hook-and-loop fastener portions 72 and 74. The arm brace 10 can then distribute the weight of an object supported at about shoulder height to the side of the user's torso in the manner illustrated in FIGS. 1, 5, and 6.

Figure 4:
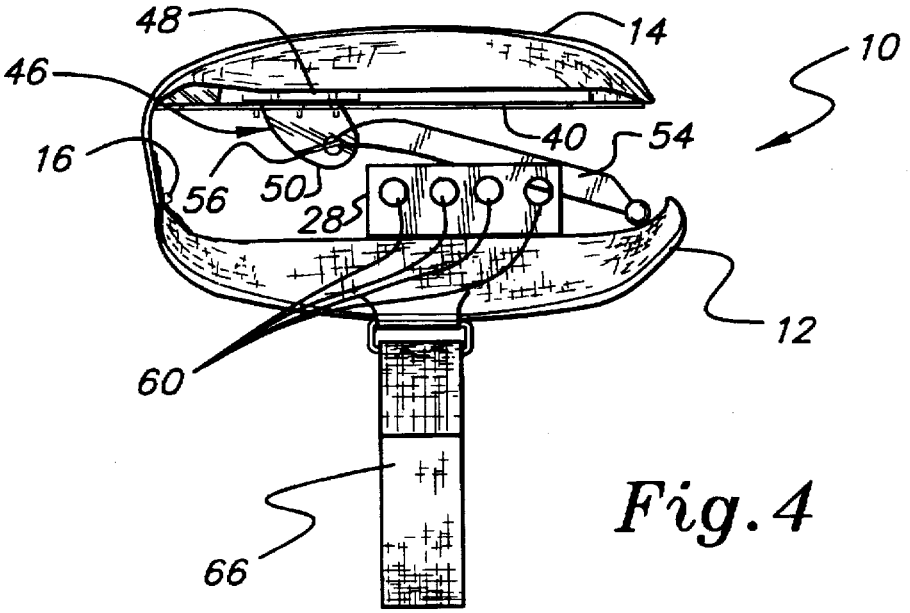
FIG. 4 is a side view of the first embodiment of the present invention shown in the collapsed state.
Figure 5:
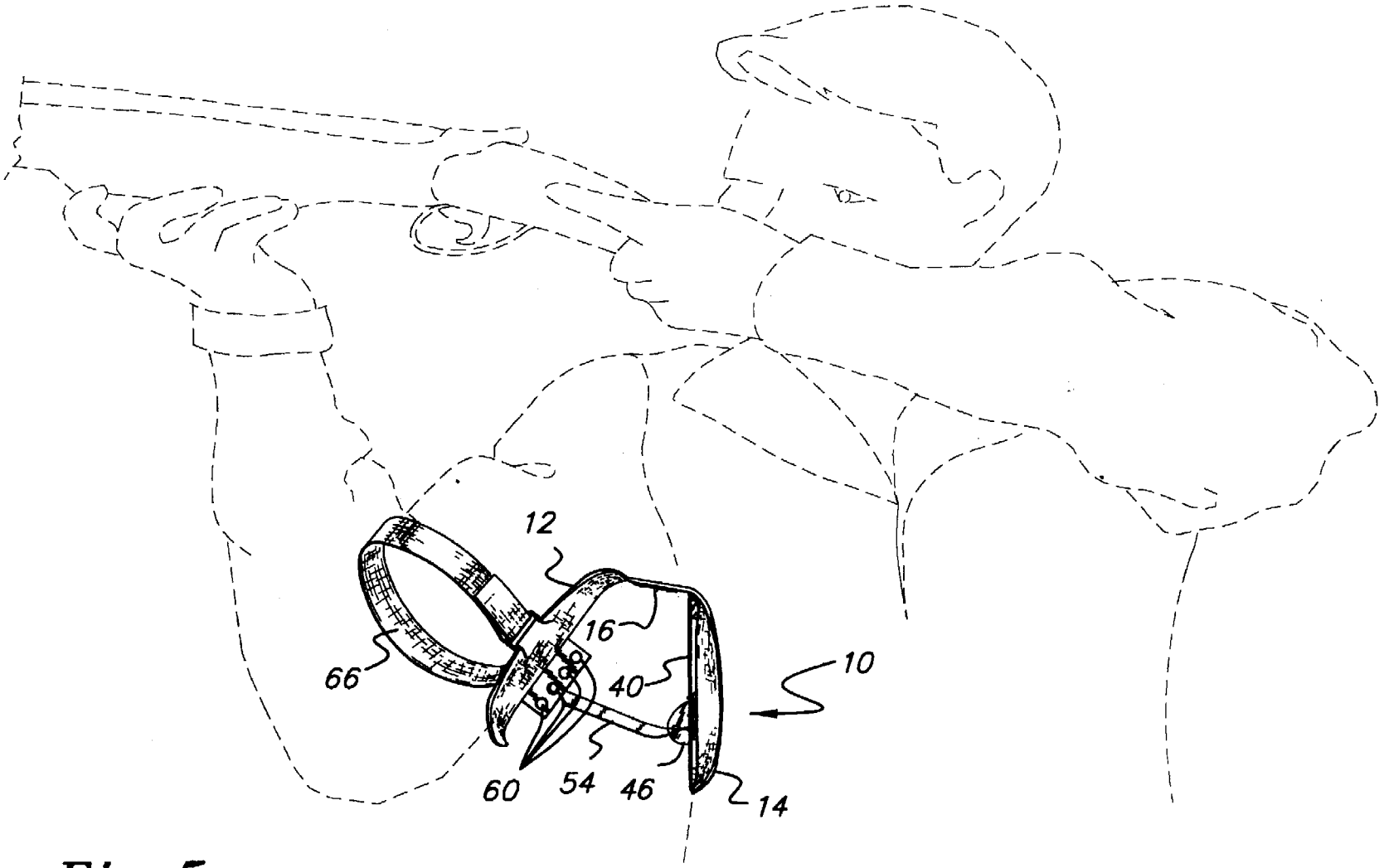
FIG. 5 is an environmental view of the first embodiment of the present invention in use by a shooter.
Figure 6:
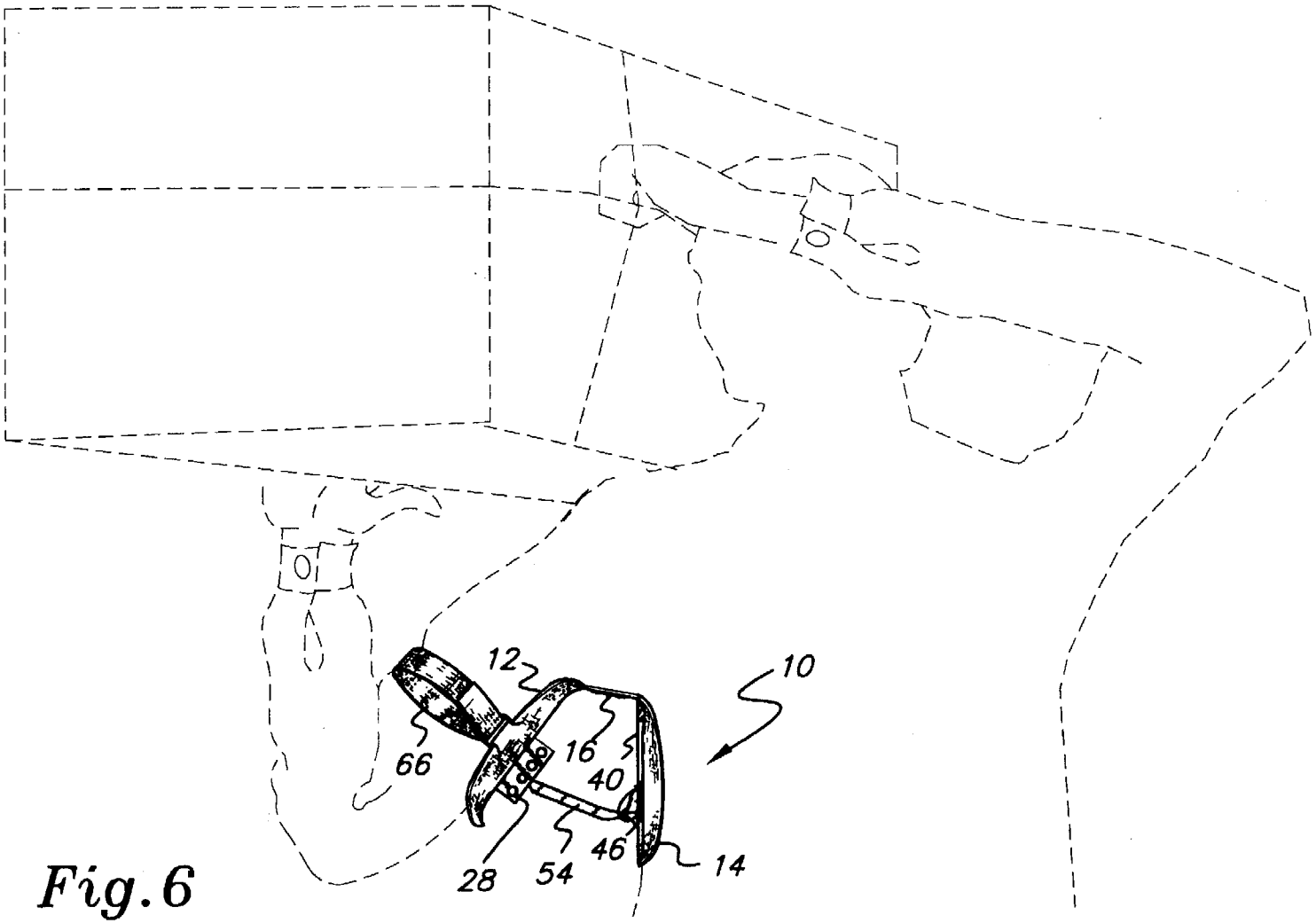
FIG. 6 shows an individual carrying a heavy box with the aid of the present invention.
Figure 7:
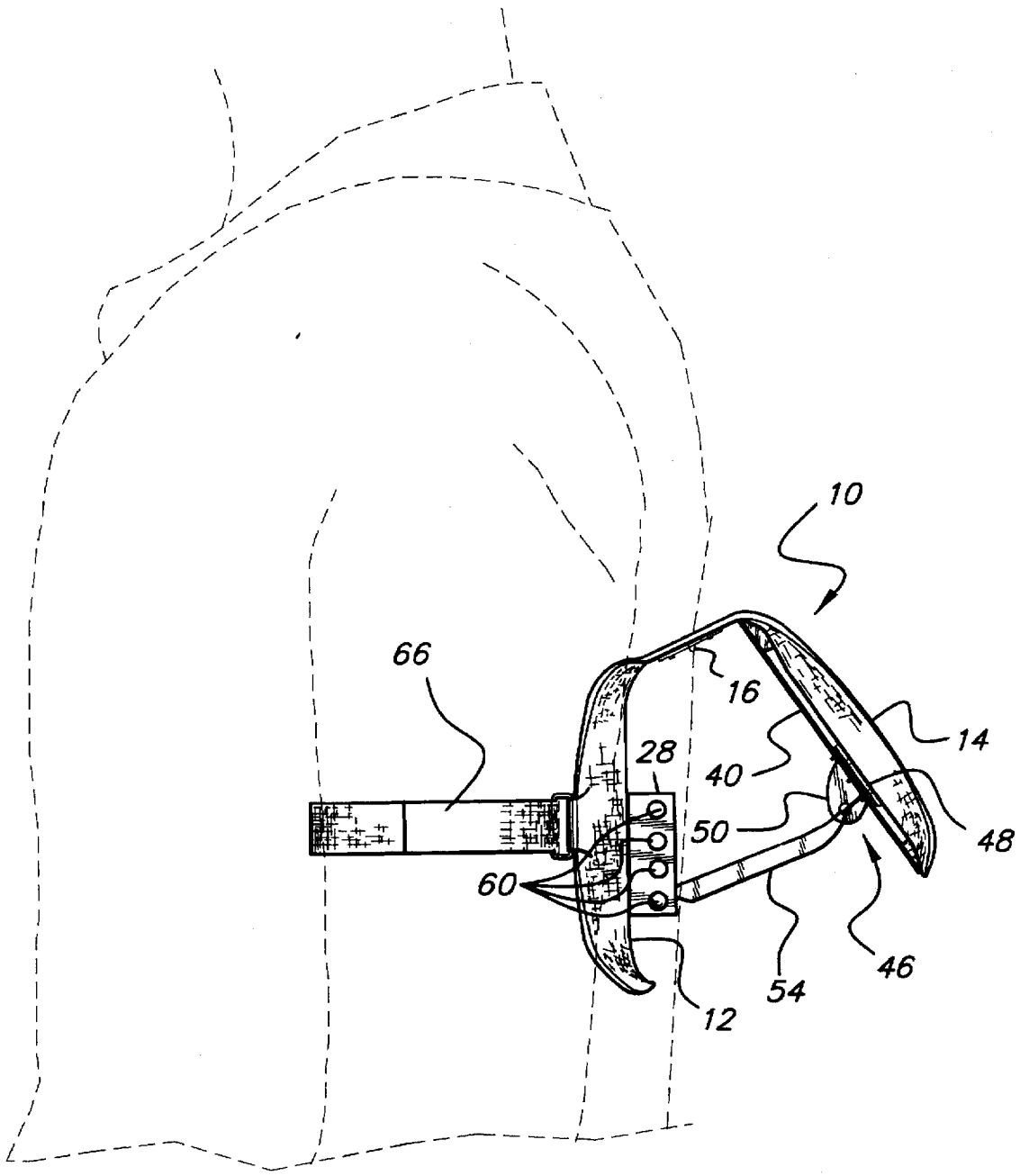
FIG. 7 is another environmental view illustrating the manner in which the present invention assumes an unobtrusive position when the user's arm is in a relaxed state.
Figure 8:
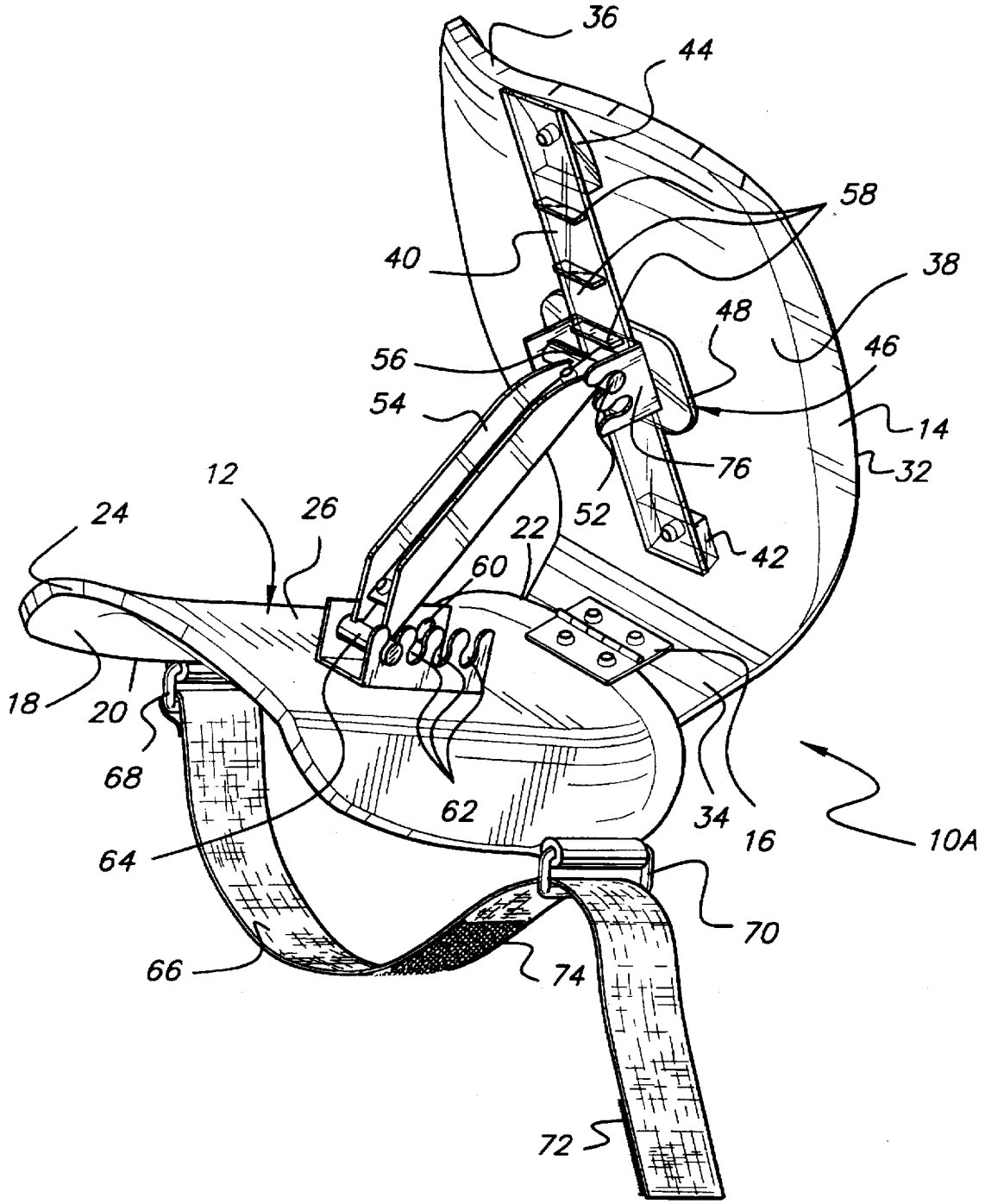
FIG. 8 is a perspective view of the second embodiment of the present invention shown with the prop attached to both body contoured surfaces.

When the shaft 64 is disengaged from the bracket 28, the arm brace 10 can be folded for storage as shown in FIG. 4. The embodiment shown in FIG. 8 is identical to that of FIGS. 1–7 except that the fins 50 are replaced by a bracket 76. Bracket 76 is similar in construction and function to bracket 28. The bracket 76 allows for the releasable attachment of the first end of the prop rod 54 to the slide 46. This allows for an additional degree of freedom in adjusting the angle between the plates 12 and 14, and the projection 56 can be cleared of the ribs 58 by detaching shaft 52 from the bracket 76 rather than by rotating the prop rod 54.

Unlike devices of the prior art which restrict the arm to give various degrees of support, the present embodiments all allow the user a much greater range of arm movement. Thus the arm brace 10 is not a restrainer of the medical variety, for example. A user may unrestrictedly outstretch arms to receive a load to be subsequently carried and/or deliver the same. As shown in FIG. 7, the arm brace 10 rotates with the arm, becoming positioned behind the user's upper arm, when the user's arm is at rest.

It is to be understood that the present invention is not limited to the embodiments described above, but encompasses any and all embodiments within the scope of the following claims.

I claim:

1. An arm brace for facilitating the carrying of an object by a user at the user's shoulder height, said arm brace comprising:

an upper arm engaging member shaped to abuttingly contact and support the user's upper arm, said upper arm engaging member having an upper arm supporting surface and a back surface;

a torso engaging member shaped to abuttingly contact the user's torso and to distribute a load applied to said torso engaging member on to the user's torso, said torso engaging member being hingedly attached to said upper arm engaging member;

a strap having a fixed end attached to said upper arm engaging member and a free end, said free end being releasably securable to said upper arm engaging member to secure said arm brace to the user's upper arm;

a prop rod having a first end and a second end, said first end of said prop rod being adjustably attached to said torso engaging member, and said second end of said prop rod being adjustably attached to said upper arm engaging member, said second end of said prop rod having a first transverse shaft fixed thereto, said first transverse shaft having a diameter; and a bracket attached to said back surface of said upper arm engaging member, said bracket having a plurality of holes and a plurality of cutouts, each of said plurality of holes being in registry with a respective one of said plurality of cutouts, each of said plurality of cutouts having an open end narrower than said diameter of said first transverse shaft, whereby an angle between said upper arm engaging member and said torso engaging member may be set by the user.

2. The arm brace according to claim 1, wherein said first end of said prop rod has a second transverse shaft fixed thereto, said torso engaging member having a torso engaging surface and a back surface, a guide attached to said back surface of said torso engaging member, and a slide slidably movable along said guide, said slide supporting said second transverse shaft.

* * * * *